US010928101B2

(12) United States Patent
Chiappetta, Jr. et al.

(10) Patent No.: US 10,928,101 B2
(45) Date of Patent: Feb. 23, 2021

(54) EJECTOR WITH MOTIVE FLOW SWIRL

(75) Inventors: Louis Chiappetta, Jr., South Windsor, CT (US); Parmesh Verma, Manchester, CT (US); Thomas D. Radcliff, Vernon, CT (US)

(73) Assignee: Carrier Corporation, Palm Beach Gardens, FL (US)

( * ) Notice: Subject to any disclaimer, the term of this patent is extended or adjusted under 35 U.S.C. 154(b) by 467 days.

(21) Appl. No.: 14/003,559

(22) PCT Filed: Apr. 10, 2012

(86) PCT No.: PCT/US2012/032910

§ 371 (c)(1),
(2), (4) Date: Sep. 6, 2013

(87) PCT Pub. No.: WO2013/002872

PCT Pub. Date: Jan. 3, 2013

(65) Prior Publication Data

US 2014/0083121 A1 Mar. 27, 2014

Related U.S. Application Data

(60) Provisional application No. 61/495,577, filed on Jun. 10, 2011.

(51) Int. Cl.

| | |
|---|---|
| ***F25B 1/06*** | (2006.01) |
| ***F25B 41/00*** | (2021.01) |
| ***F25B 49/02*** | (2006.01) |

(52) U.S. Cl.

CPC ..... *F25B 1/06* (2013.01); *F25B 41/00* (2013.01); *F25B 49/02* (2013.01); *F25B 2341/0012* (2013.01); *F25B 2341/0013* (2013.01)

(58) Field of Classification Search

CPC ..... F25B 2341/00; F25B 2341/0013; F25B 2341/0012; F25B 49/02; F25B 1/06

(Continued)

(56) References Cited

U.S. PATENT DOCUMENTS 1,369,688 A * 2/1921 Mayer ..... F23D 11/10 122/367.3

1,836,318 A 12/1931 Gay (Continued)

FOREIGN PATENT DOCUMENTS

CN 1460824 A 12/2003
CN 1527007 A 9/2004

(Continued)

OTHER PUBLICATIONS

Yamada et al., Fuel Injection Valve, Dec. 11, 1996., PAJ, JP 08-296531, all.*

(Continued)

*Primary Examiner* — Filip Zec

(74) *Attorney, Agent, or Firm* — Bachman & LaPointe, P.C.

(57) ABSTRACT

An ejector (200; 300; 400) has a primary inlet (40), a secondary inlet (42), and an outlet (44). A primary flowpath extends from the primary inlet to the outlet. A secondary flowpath extends from the secondary inlet to the outlet. A mixer convergent section (114) is downstream of the secondary inlet. A motive nozzle (100) surrounds the primary flowpath upstream of a junction with the secondary flowpath to pass a motive flow. The motive nozzle has an exit (110). The ejector has surfaces (258, 260) positioned to introduce swirl to the motive flow.

19 Claims, 6 Drawing Sheets

(58) Field of Classification Search
USPC ..... 239/461, 463, 482, 490, 399
See application file for complete search history.

(56) References Cited

U.S. PATENT DOCUMENTS

| | | | | |
|---|---|---|---|---|
| 3,277,660 | A | 10/1966 | Kemper et al. | |
| 4,378,681 | A | 4/1983 | Modisette | |
| 5,133,194 | A | 7/1992 | Army, Jr. et al. | |
| 5,230,656 | A | 7/1993 | Paterson et al. | |
| 5,363,699 | A * | 11/1994 | McCall | F15D 1/02 138/37 |
| 5,832,744 | A * | 11/1998 | Dorste et al. | 62/528 |
| 6,210,123 | B1 * | 4/2001 | Wittrisch | F04F 5/466 417/194 |
| 6,343,750 | B1 * | 2/2002 | Engel | B05B 7/0425 239/463 |
| 6,578,777 | B2 * | 6/2003 | Bui | B05B 7/0475 239/406 |
| 6,638,055 | B2 * | 10/2003 | Carroni | F23C 7/002 431/268 |
| 6,854,260 | B2 * | 2/2005 | Anderson | F02K 1/46 181/213 |
| 6,931,887 | B2 * | 8/2005 | Ogata et al. | 62/500 |
| 6,935,578 | B1 * | 8/2005 | Shibata | B05B 1/3431 239/463 |
| 7,832,653 | B2 * | 11/2010 | Yukimoto | 236/92 B |
| 2001/0025499 | A1 * | 10/2001 | Takeuchi et al. | 62/175 |
| 2005/0188719 | A1 | 9/2005 | Sugiura et al. | |
| 2008/0000263 | A1 | 1/2008 | Oomura et al. | |
| 2008/0209914 | A1 | 9/2008 | De Wergifosse et al. | |
| 2010/0147021 | A1 | 6/2010 | Betting et al. | |
| 2010/0175381 | A1 * | 7/2010 | Wilbraham | F23C 7/004 60/737 |
| 2010/0175422 | A1 | 7/2010 | Yamada et al. | |
| 2010/0276517 | A1 * | 11/2010 | Alansary | B05B 7/0416 239/399 |
| 2011/0030390 | A1 | 2/2011 | Charamko et al. | |
| 2012/0228405 | A1 * | 9/2012 | Buelow | F23R 3/28 239/463 |

FOREIGN PATENT DOCUMENTS

| | | | |
|---|---|---|---|
| CN | 101532760 | A | 9/2009 |
| GB | 575024 | A | 1/1946 |
| JP | 10246500 | A | 9/1998 |
| JP | 11257299 | A | 9/1999 |
| JP | 2008202812 | A | 9/2008 |
| JP | 2008232458 | A | 10/2008 |
| JP | 2010210111 | A | 9/2010 |

OTHER PUBLICATIONS

International Search Report and Written Opinion for PCT/US2012/032910, dated Dec. 21, 2012.

Chinese Office Action for Chinese Patent Application No. 201280028365.4, dated Feb. 3, 2015.

Chinese Office Action for Chinese Patent Application No. 201280028365.4, dated Sep. 21, 2015.

European Office Action dated Jun. 14, 2017 for European Patent Application No. 12783379.6.

European Office Action dated May 8, 2019 for European Patent Application No. 12783379.6.

* cited by examiner

EJECTOR WITH MOTIVE FLOW SWIRL

CROSS-REFERENCE TO RELATED APPLICATION

Benefit is claimed of U.S. patent application Ser. No. 61/495,577, filed Jun. 10, 2011, and entitled "Ejector with Motive Flow Swirl", the disclosure of which is incorporated by reference herein in its entirety as if set forth at length.

US GOVERNMENT RIGHTS

The invention was made with US Government support under contract W909MY-10-C-0005 awarded by the US Army. The US Government has certain rights in the invention.

BACKGROUND

The present disclosure relates to refrigeration. More particularly, it relates to ejector refrigeration systems.

Earlier proposals for ejector refrigeration systems are found in U.S. Pat. Nos. 1,836,318 and 3,277,660. FIG. 1 shows one basic example of an ejector refrigeration system 20. The system includes a compressor 22 having an inlet (suction port) 24 and an outlet (discharge port) 26. The compressor and other system components are positioned along a refrigerant circuit or flowpath 27 and connected via various conduits (lines). A discharge line 28 extends from the outlet 26 to the inlet 32 of a heat exchanger (a heat rejection heat exchanger in a normal mode of system operation (e.g., a condenser or gas cooler)) 30. A line 36 extends from the outlet 34 of the heat rejection heat exchanger 30 to a primary inlet (liquid or supercritical or two-phase inlet) 40 of an ejector 38. The ejector 38 also has a secondary inlet (saturated or superheated vapor or two-phase inlet) 42 and an outlet 44. A line 46 extends from the ejector outlet 44 to an inlet 50 of a separator 48. The separator has a liquid outlet 52 and a gas outlet 54. A suction line 56 extends from the gas outlet 54 to the compressor suction port 24. The lines 28, 36, 46, 56, and components therebetween define a primary loop 60 of the refrigerant circuit 27. A secondary loop 62 of the refrigerant circuit 27 includes a heat exchanger 64 (in a normal operational mode being a heat absorption heat exchanger (e.g., evaporator)). The evaporator 64 includes an inlet 66 and an outlet 68 along the secondary loop 62 and expansion device 70 is positioned in a line 72 which extends between the separator liquid outlet 52 and the evaporator inlet 66. An ejector secondary inlet line 74 extends from the evaporator outlet 68 to the ejector secondary inlet 42.

In the normal mode of operation, gaseous refrigerant is drawn by the compressor 22 through the suction line 56 and inlet 24 and compressed and discharged from the discharge port 26 into the discharge line 28. In the heat rejection heat exchanger, the refrigerant loses/rejects heat to a heat transfer fluid (e.g., fan-forced air or water or other fluid). Cooled refrigerant exits the heat rejection heat exchanger via the outlet 34 and enters the ejector primary inlet 40 via the line 36.

The exemplary ejector 38 (FIG. 2) is formed as the combination of a motive (primary) nozzle 100 nested within an outer member 102. The primary inlet 40 is the inlet to the motive nozzle 100. The outlet 44 is the outlet of the outer member 102. The primary refrigerant flow (motive flow) 103 enters the inlet 40 and then passes into a convergent section 104 of the motive nozzle 100. It then passes through a throat section 106 and an expansion (divergent) section

108 through an outlet (exit) 110 of the motive nozzle 100. The motive nozzle 100 accelerates the flow 103 and decreases the pressure of the flow. The secondary inlet 42 forms an inlet of the outer member 102. The pressure reduction caused to the primary flow by the motive nozzle helps draw the secondary flow (suction flow) 112 into the outer member. The outer member includes a mixer having a convergent section 114 and an elongate throat or mixing section 116. The outer member also has a divergent section or diffuser 118 downstream of the elongate throat or mixing section 116. The motive nozzle outlet 110 is positioned within the convergent section 114. As the flow 103 exits the outlet 110, it begins to mix with the flow 112 with further mixing occurring through the mixing section 116 which provides a mixing zone. Thus, respective primary and secondary flowpaths extend from the primary inlet and secondary inlet to the outlet, merging at the exit. In operation, the primary flow 103 may typically be supercritical upon entering the ejector and subcritical upon exiting the motive nozzle. The secondary flow 112 is gaseous (or a mixture of gas with a smaller amount of liquid) upon entering the secondary inlet port 42. The resulting combined flow 120 is a liquid/vapor mixture and decelerates and recovers pressure in the diffuser 118 while remaining a mixture. Upon entering the separator, the flow 120 is separated back into the flows 103 and 112. The flow 103 passes as a gas through the compressor suction line as discussed above. The flow 112 passes as a liquid to the expansion valve 70. The flow 112 may be expanded by the valve 70 (e.g., to a low quality (two-phase with small amount of vapor)) and passed to the evaporator 64. Within the evaporator 64, the refrigerant absorbs heat from a heat transfer fluid (e.g., from a fan-forced air flow or water or other liquid) and is discharged from the outlet 68 to the line 74 as the aforementioned gas.

Use of an ejector serves to recover pressure/work. Work recovered from the expansion process is used to compress the gaseous refrigerant prior to entering the compressor. Accordingly, the pressure ratio of the compressor (and thus the power consumption) may be reduced for a given desired evaporator pressure. The quality of refrigerant entering the evaporator may also be reduced. Thus, the refrigeration effect per unit mass flow may be increased (relative to the non-ejector system). The distribution of fluid entering the evaporator is improved (thereby improving evaporator performance). Because the evaporator does not directly feed the compressor, the evaporator is not required to produce superheated refrigerant outflow. The use of an ejector cycle may thus allow reduction or elimination of the superheated zone of the evaporator. This may allow the evaporator to operate in a two-phase state which provides a higher heat transfer performance (e.g., facilitating reduction in the evaporator size for a given capability).

The exemplary ejector may be a fixed geometry ejector or may be a controllable ejector. FIG. 2 shows controllability provided by a needle valve 130 having a needle 132 and an actuator 134. The actuator 134 shifts a tip portion 136 of the needle into and out of the throat section 106 of the motive nozzle 100 to modulate flow through the motive nozzle and, in turn, the ejector overall. Exemplary actuators 134 are electric (e.g., solenoid or the like). The actuator 134 may be coupled to and controlled by a controller 140 which may receive user inputs from an input device 142 (e.g., switches, keyboard, or the like) and sensors (not shown). The controller 140 may be coupled to the actuator and other controllable system components (e.g., valves, the compressor motor, and the like) via control lines 144 (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components. U.S. Pat. No. 4,378,681 discloses another form of ejector device wherein tangential introduction of the secondary flow and withdrawal of the combined flow is used to provide a longer residence time of the fluid.

SUMMARY

One aspect of the disclosure involves an ejector having a primary inlet, a secondary inlet, and an outlet. A primary flowpath extends from the primary inlet to the outlet. A secondary flowpath extends from the secondary inlet to the outlet. A mixer convergent section is downstream of the secondary inlet. A motive nozzle surrounds the primary flowpath upstream of a junction with the secondary flowpath. The motive nozzle has an exit. The nozzle includes means for introducing swirl to the motive flow.

In various implementations, there may be only a single motive nozzle. The motive nozzle may be coaxial with a central longitudinal axis of the ejector. The means may introduce swirl upstream of the junction. The means may be inside the motive nozzle. The means may comprise vanes. A needle may be mounted for reciprocal movement along the primary flowpath between a first position and a second position. A needle actuator may be coupled to the needle to drive the movement of the needle relative to the motive nozzle.

Other aspects of the disclosure involve a refrigeration system having a compressor, a heat rejection heat exchanger coupled to the compressor to receive refrigerant compressed by the compressor, a heat absorption heat exchanger, a separator, and such an ejector. An inlet of the separator may be coupled to the outlet of the ejector to receive refrigerant from the ejector.

The details of one or more embodiments are set forth in the accompanying drawings and the description below. Other features, objects, and advantages will be apparent from the description and drawings, and from the claims.

DETAILED DESCRIPTION

Figure 1:
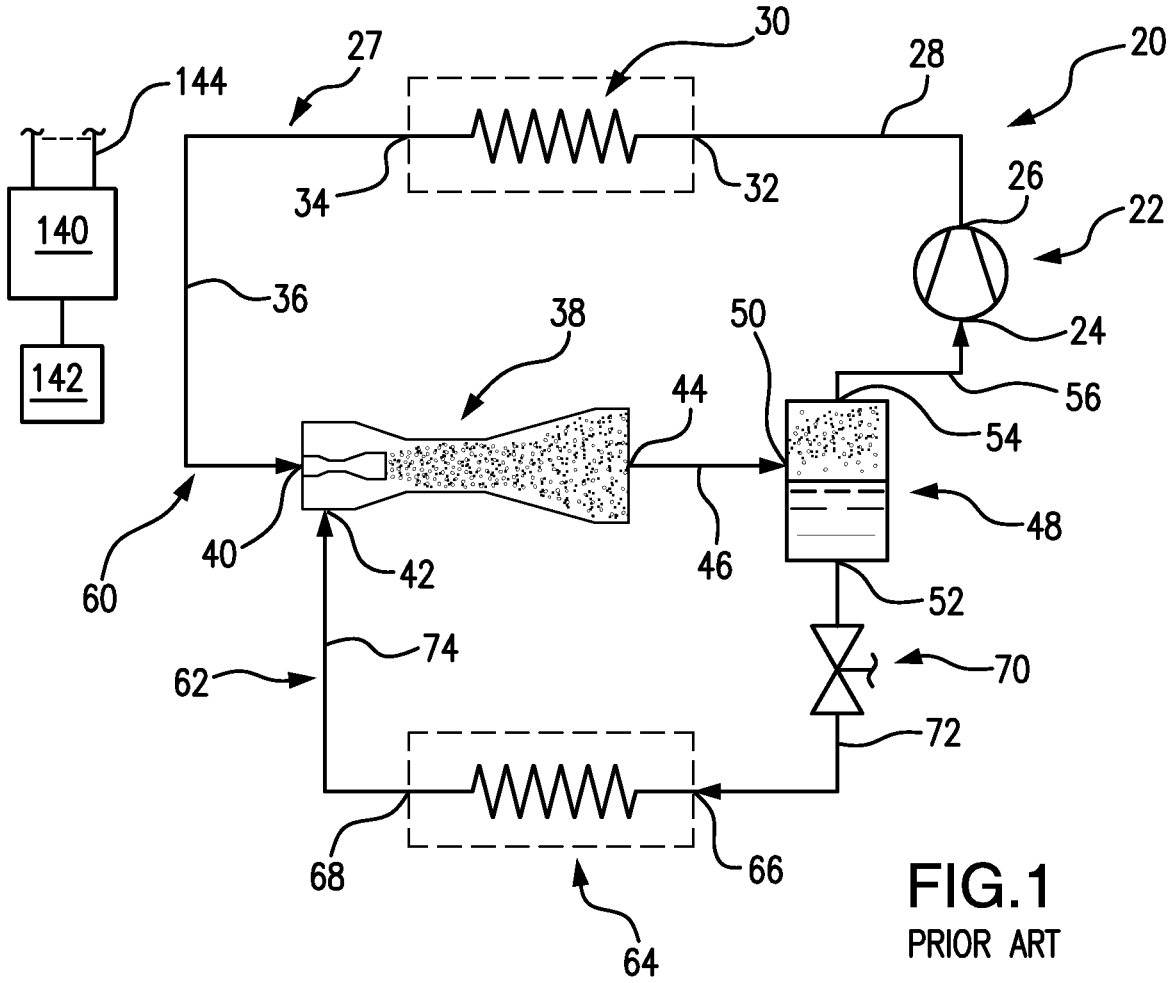
FIG.1 PRIOR ART
FIG. 1 is a schematic view of a prior art ejector refrigeration system.
Figure 2:
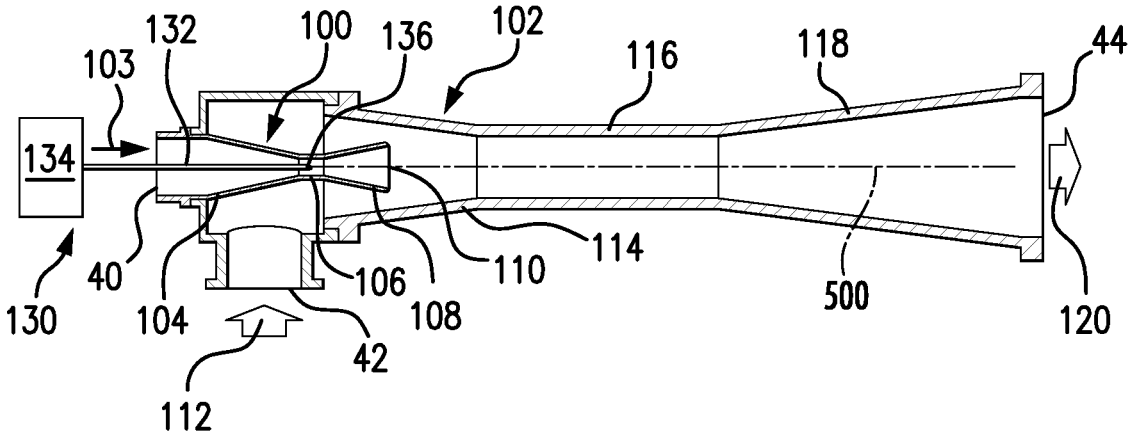
FIG. 2 PRIOR ART
FIG. 2 is an axial sectional view of a prior art ejector.
Figure 3:
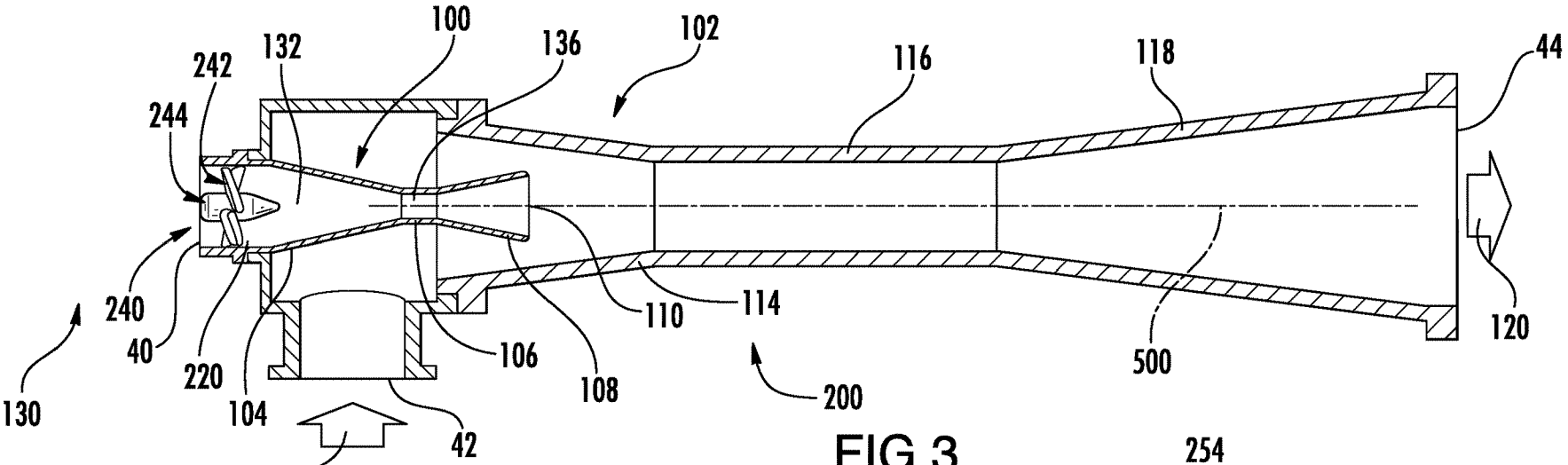
FIG. 3 is an axial sectional view of a first ejector.
Figure 5:
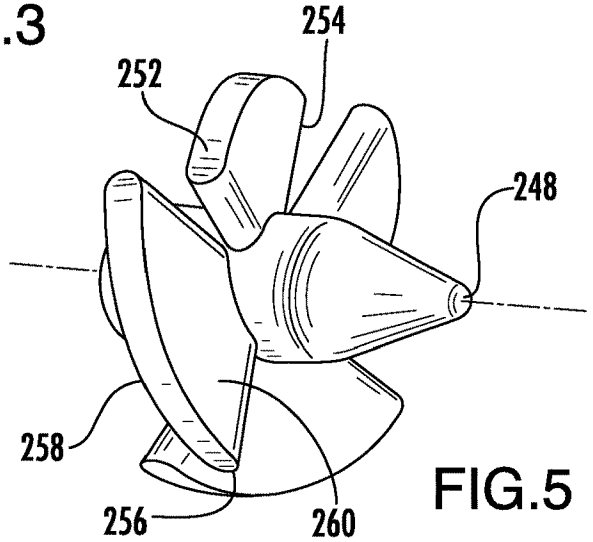
FIG. 5 is a second view of the vane unit of FIG. 4.
Figure 4:
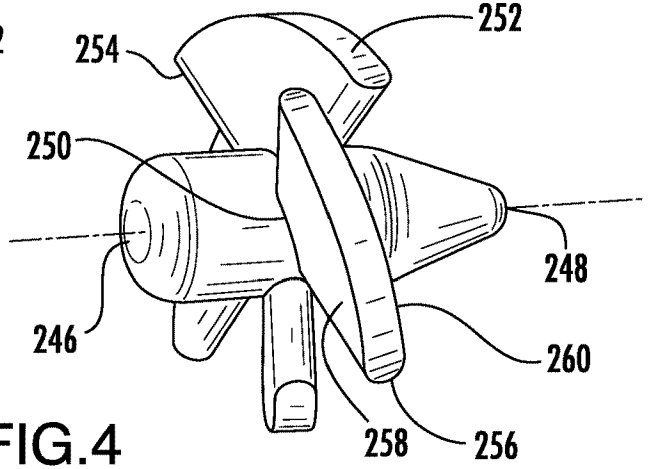
FIG. 4 is a first enlarged view of a vane unit of the motive nozzle of the ejector of FIG. 3.

FIG. 3 shows an ejector 200. The ejector 200 (and 300 described later) may be formed as a modification of the ejector 38 and may be used in vapor compression systems (e.g., FIG. 1) where conventional ejectors are presently used or may be used in the future. An exemplary ejector is a two-phase ejector used with $CO_2$ refrigerant (e.g., at least 50% $CO_2$ by weight). For ease of illustration, the exemplary ejector 200 is shown as a modification of the baseline ejector 38 of FIG. 2. Accordingly, the exemplary ejector may have similar features and, for ease of illustration, many reference numerals are not repeated. However, the ejector may be formed as modification of other configurations of ejector.

The ejector 200 comprises means for imparting swirl to the motive flow. Exemplary means is, therefore, located along the primary flowpath upstream of the motive nozzle exit. More particularly, in the FIG. 3 embodiment, the exemplary means comprises a fixed swirler 240 positioned not merely upstream of the motive nozzle exit but also upstream of the motive nozzle throat and of the motive nozzle convergent section. The exemplary swirler 240 is located in a straight section 220 of the motive nozzle immediately between the motive nozzle inlet 40 and the upstream end of the convergent section 104. The exemplary swirler 240 comprises a plurality of pitched vanes 242 extending radially outward from a centerbody 244. The centerbody 244 is centered along the axis 500 from an upstream end 246 to a downstream end 248. Each vane extends radially outward from an inboard end 250 at the centerbody to an outboard end 252 at the inner surface of the straight section 220. Each exemplary vane has a leading edge 254 and a trailing edge 256 with a respective upstream surface 258 and downstream surface 260 extending therebetween. The exemplary upstream and downstream surfaces are generally flat so that, in circumferential cross-section, they appear straight and joined by exemplary semicircular transitions at the leading edge 254 and trailing edge 256. Other configurations are possible with relatively airfoil-like sections. The exemplary embodiment has four such vanes although greater or fewer numbers are possible (e.g., 2-8 such vanes).

The motive (liquid) flow swirl enhances penetration and mixing of the suction (gas) phase flow. If a liquid core is rotating sufficiently fast within a gas core (which may be rotating or non-rotating), the liquid has a tendency to be moved outward by centrifugal force because the initial situation is hydrodynamically unstable. By such mixing, ejector efficiency, which measures the pressure rise relative to the entrainment ratio, can be increased.

Figure 6:
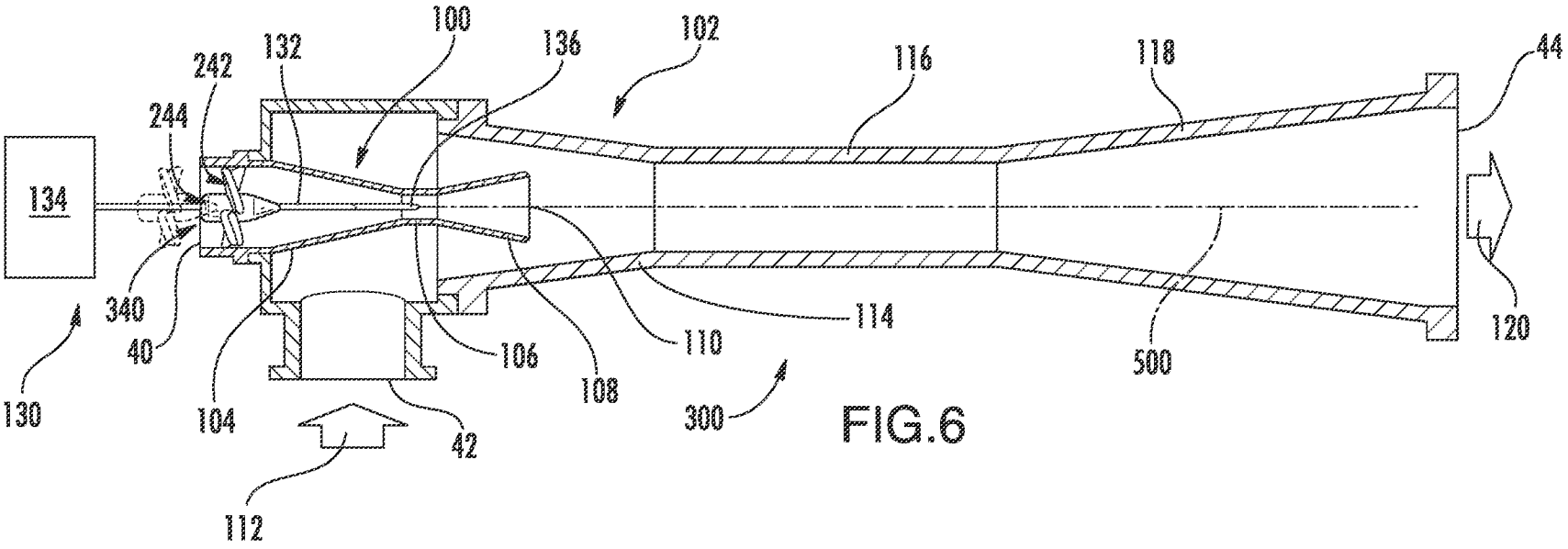
FIG. 6 is an axial sectional view of a second ejector.

FIG. 6 shows a similar ejector 300 but wherein the swirler 340 is mounted on the needle. The swirler may move with the needle (with the outboard ends 252 thus slide against the inner surface of the straight portion 220). Alternatively, the swirler may be fixed and the needle may simply slide through a bore in the centerbody.

Figure 7:
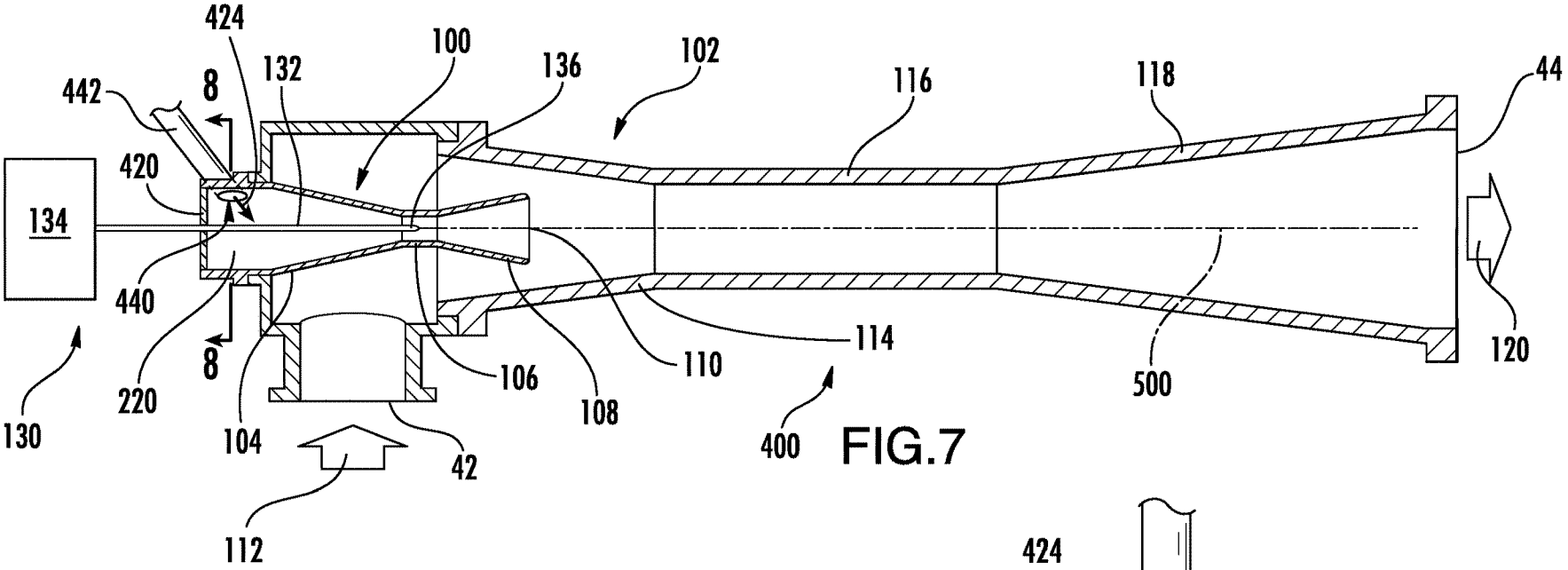
FIG. 7 is an axial sectional view of a third ejector.

FIG. 7 shows yet an alternative configuration of an ejector 400 wherein the primary flow enters not purely axially but rather with a tangential component. In this exemplary embodiment, a plate 420 closes the axially upstream end of the motive nozzle (the exemplary plate 420 has an aperture through which the needle may extend). The flow enters an inlet 440 along the sidewall of the straight section 220 at the terminus of the inlet conduit 442. The exemplary inlet flow 424 has a tangential component about the centerline 500 (e.g., it is not aimed directly at the centerline).

Figure 8:
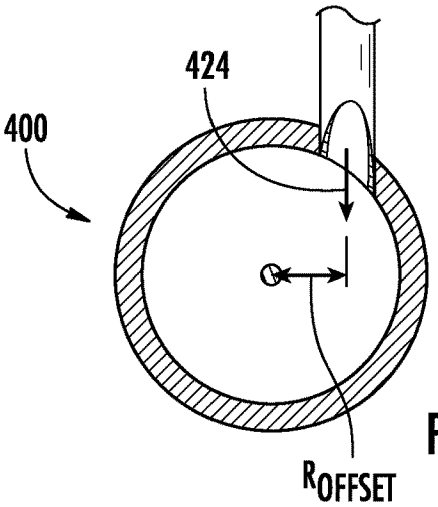
FIG. 8 is a transverse sectional view of the ejector of FIG. 7, taken along line 8-8.

FIG. 8 characterizes this tangential component with a radial offset $R_{OFFSET}$ of the inlet flow vector relative to the axis 500.

Figure 9:
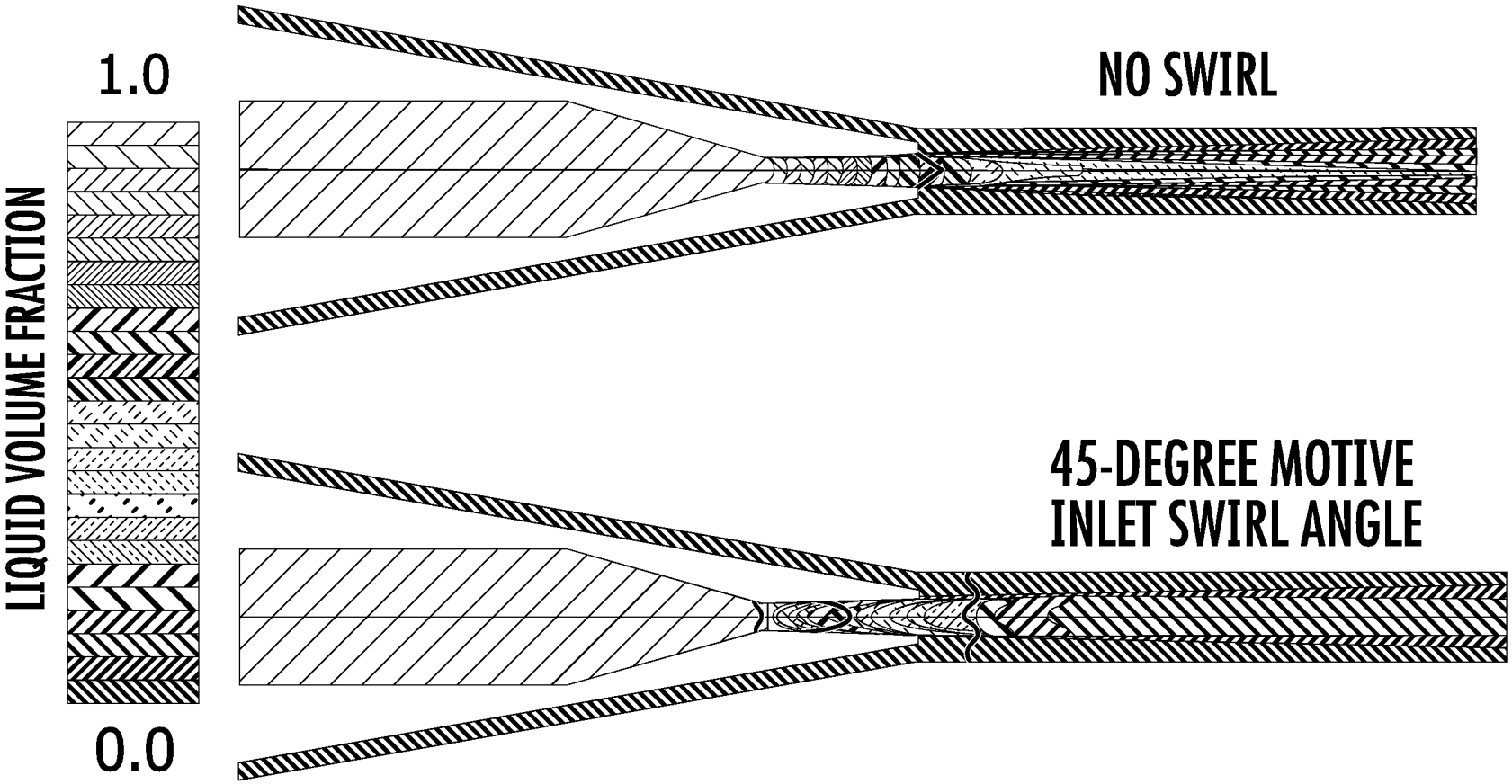
FIG. 9 is a comparative flow simulation plot of liquid fraction for a baseline swirl-less ejector and an ejector with swirled motive flow.
Figure 10:
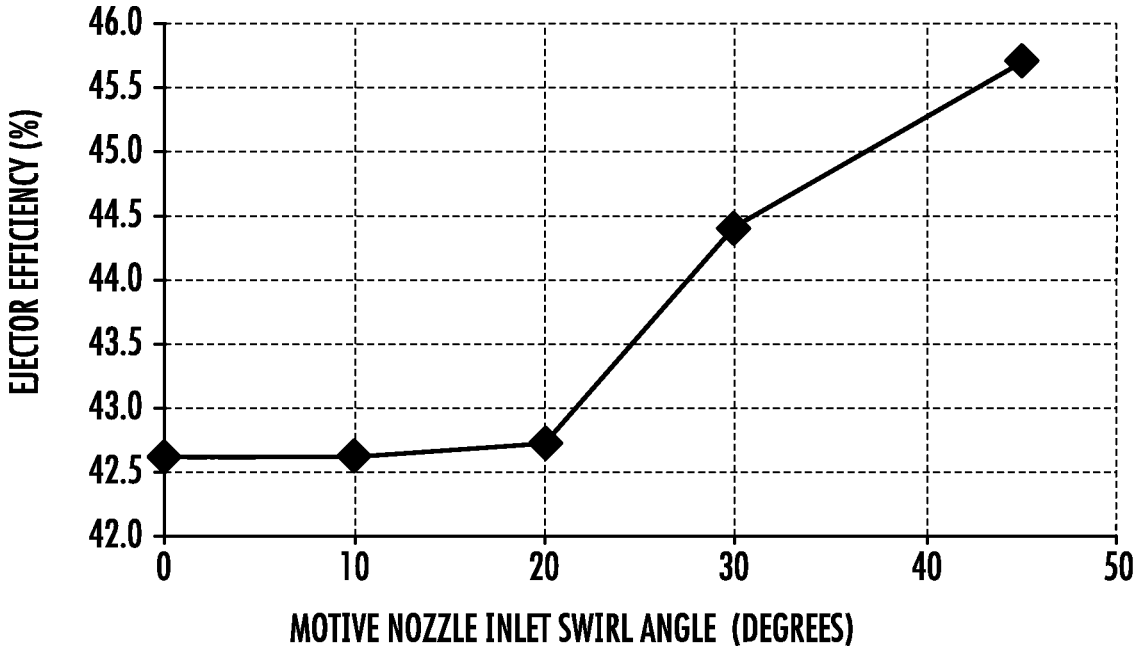
FIG. 10 is a calculated graph of ejector efficiency vs. motive nozzle inlet swirl for an exemplary ejector configuration Like reference numbers and designations in the various drawings indicate like elements.

FIGS. 9 and 10 disclose flow parameters and performance for an ejector where swirl is introduced upstream of the motive nozzle convergent section 104 (e.g., immediately upstream). This example facilitates a simple characterization of the swirl as an inlet swirl (as being measured at the beginning of the convergent section). Swirl, however may be introduced further downstream but may be more complicated to quantify for purposes of illustration.

For a given inlet swirl angle (the tangent of which is the ratio of circumferential to axial velocity components), the swirl angle increases from the inlet to the throat and then decreases to the nozzle exit. If the inlet-to-throat diameter ratio is larger than the exit-to-throat diameter ratio, there is more swirl at the nozzle exit. It may be impractical to place a swirler in the supersonic-flow portion of the nozzle (e.g., the portion of the motive nozzle downstream of the throat, or minimum area location) because the swirler will generate shocks and possibly choke the flow, in either case increasing the exit pressure. It is generally desirable to have the nozzle flow over-expanded; the nozzle exit pressure is then less than the local static pressure of the suction flow.

FIG. 9 shows comparative flow simulation plots of liquid fraction for a baseline swirl-less ejector and an ejector with swirled motive flow at an exemplary 45°. From this, it is seen that the flow with motive-nozzle inlet swirl is better mixed in the divergent mixer, as indicated by the contour colors indicating lower liquid volume fraction. Swirl introduced into the motive flow leads to hydrodynamically unstable flow at mixing with high-density swirling flow contained within low-density, non-swirling flow. Centrifugal forces displace the motive flow outward, drawing the suction flow inward, improving mixing and phase change leading to increased efficiency.

FIG. 10 shows ejector efficiency vs. motive nozzle inlet swirl for an exemplary ejector configuration. Above an inlet swirl angle of 20° (to about 45° or somewhat higher), there is a notable increase in performance (efficiency or pressure rise). The particular angles associated with performance increase in a given ejector configuration and given operating condition will depend on ejector operating conditions (e.g., inlet pressures, temperatures and entrainment ratio) and geometry. Thus, broadly, exemplary swirl angles at the beginning of the convergent section of the motive nozzle are greater than 20°, more narrowly greater than 30°, with exemplary ranges of 20-50° or 30-50°. For swirl introduced further downstream, the swirl-inducing surfaces might be chosen to produce swirl at the mixer outlet/exit of the same magnitude as the mixer outlet/exit swirl associated with those ranges of inlet swirl.

The ejectors and associated vapor compression systems may be fabricated from conventional materials and components using conventional techniques appropriate for the particular intended uses. Control may also be via conventional methods. Although the exemplary ejectors are shown omitting a control needle, such a needle and actuator may, however, be added.

In the exemplary ejector, the motive and suction flows are arranged in the typical fashion, with the motive flow nozzle surrounded by the suction flow. The motive flow density is generally higher than that of the suction flow. When swirl is imparted to the motive fluid in a manner, such as described above, and the motive and suction flows are then allowed to interact (mix), centrifugal force tends to displace outward the rotating, higher-density motive flow into the lower-density suction flow, thereby enhancing mixing and increasing ejector performance (pressure rise). The situation is termed fluid dynamically, or hydrodynamically, unstable because the rotating, higher-density fluid is moved by the swirl-induced centrifugal force from the center of the mixing section toward the outer region, displacing inward the lower density suction flow, thereby creating a hydrodynamically stable configuration. In U.S. Pat. No. 4,378,681 (the '681 patent), swirl is imparted to the suction flow. In the '681 patent, the performance enhancing mechanism is evidently the longer contact time between the two flows increasing shear-driven mixing. The fluid particles at the interface of the two flows will follow a spiral path that is longer than the axial distance from the point where the two flows first interact to the point when they are sufficiently mixed.

Although an embodiment is described above in detail, such description is not intended for limiting the scope of the present disclosure. It will be understood that various modifications may be made without departing from the spirit and scope of the disclosure. For example, when implemented in the remanufacturing an existing system or the reengineering of an existing system configuration, details of the existing configuration may influence or dictate details of any particular implementation. Accordingly, other embodiments are within the scope of the following claims.

What is claimed is:

1. An ejector (300) comprising:
- a primary inlet (40) for admitting a liquid or supercritical or two-phase motive flow;
- a secondary inlet (42);
- an outlet (44);
- a primary flowpath from the primary inlet;
- a secondary flowpath from the secondary inlet;
- a mixer convergent section (114) downstream of the secondary inlet; and
- a motive nozzle (100) surrounding the primary flowpath upstream of a junction with the secondary flowpath and having an exit (110), wherein the ejector further comprises:
- means (340) for introducing swirl to the motive flow prior to mixing with a saturated or superheated vapor or two-phase secondary flow from the secondary flowpath; and
- a control needle, wherein the means is selected from the group consisting of:
  - the means mounted on the needle to move therewith; and
  - the means through which the control needle slides.

2. The ejector of claim 1 wherein:
there is only a single motive nozzle.

3. The ejector of claim 1 wherein:
the means for introducing swirl introduces swirl upstream of the junction.

4. The ejector of claim 1 wherein:
the means for introducing swirl is inside the motive nozzle.

5. The ejector of claim 4 wherein:
the means for introducing swirl comprises a plurality of vanes (242).

6. The ejector of claim 5 wherein:
the vanes are carried on the control needle (132).

7. The ejector of claim 5 wherein:
the vanes are fixed upstream of a convergent portion (104) of the motive nozzle.

8. The ejector of claim 5 wherein:
the vanes extend radially outward from a centerbody (244).

9. The ejector of claim 4 wherein:
a swirl angle at a beginning of a convergent section of the motive nozzle is 30-50°.

10. The ejector of claim 1 wherein:

a swirl angle at a beginning of a convergent section of the motive nozzle is at least 20°.

11. A vapor compression system comprising:

a compressor (22);

a heat rejection heat exchanger (30) coupled to the compressor to receive refrigerant compressed by the compressor;

the ejector of claim 1;

a heat absorption heat exchanger (64); and a separator (48) having:

an inlet (50) coupled to the outlet of the ejector to receive refrigerant from the ejector;

a gas outlet (54); and a liquid outlet (52).

12. A method for operating the system of claim 11, the method comprising:

compressing the refrigerant in the compressor;

rejecting heat from the compressed refrigerant in the heat rejection heat exchanger;

passing said liquid or supercritical or two-phase motive flow of the refrigerant through the primary inlet; and passing said saturated or superheated vapor or two-phase secondary flow of the refrigerant through the secondary inlet to merge with the motive flow.

13. The method of claim 12 wherein:

the refrigerant comprises at least 50% $CO_2$ by weight.

14. The method of claim 12 wherein:

a swirl angle at a beginning of a convergent section of the motive nozzle is at least 20°.

15. The ejector of claim 1 wherein:

the control needle slides through the means for introducing swirl.

16. A method for operating an ejector (300), the method comprising:

passing a liquid or supercritical or two-phase motive flow (103) through a motive nozzle;

axially translating a control needle (132) to control the motive flow;

passing a saturated or superheated vapor or two-phase suction flow (112) through a suction port;

mixing the motive flow and the suction flow; and imparting swirl to the motive flow prior to the mixing, wherein:

the imparting swirl to the motive flow comprises passing the motive flow over redirecting surfaces (258, 260) in the motive nozzle; and the redirecting surfaces are formed along vanes (242) selected from the group consisting of:

vanes (242) mounted to the control needle; and vanes extending from a centerbody within which centerbody the control needle slides.

17. The method of claim 16 wherein:

the vanes (242) are mounted to the control needle.

18. The method of claim 16 wherein:

the vanes extend from the centerbody.

19. The method of claim 16 wherein:

a swirl angle at a beginning of a convergent section of the motive nozzle is at least 20°.

* * * * *